United States Patent [19]

Arvaï

[11] 4,191,119

[45] Mar. 4, 1980

[54] SEWING MACHINES

[75] Inventor: Tibor Arvaï, Monte Carlo, Monaco

[73] Assignee: "Meci" Materiel Electrique de Controle et Industriel, Paris, France

[21] Appl. No.: 872,135

[22] Filed: Jan. 25, 1978

[30] Foreign Application Priority Data

Feb. 2, 1977 [MC] Monaco ..... 1228

[51] Int. Cl.[2] ..... D05B 3/02

[52] U.S. Cl. ..... 112/158 R; 112/221; 112/259

[58] Field of Search ..... 112/221, 270, 226, 227, 112/222, 220, 258, 259, 157, 158 R, 158 A, 158 B, 158 C, 158 D

[56] References Cited

U.S. PATENT DOCUMENTS

| | | | |
|---|---|---|---|
| 602,988 | 4/1898 | Jerram | 112/221 |
| 662,004 | 11/1900 | Lawrence | 112/221 X |
| 1,672,353 | 6/1928 | Tomich | 112/221 |
| 2,662,495 | 12/1953 | Parry | 112/221 X |
| 3,204,594 | 9/1965 | Dreyfuss | 112/258 |

FOREIGN PATENT DOCUMENTS

| | | | |
|---|---|---|---|
| 1281251 | 1/1963 | Fed. Rep. of Germany | 112/221 |

*Primary Examiner*—H. Hampton Hunter

*Attorney, Agent, or Firm*—Pollock, Vande Sande & Priddy

[57] ABSTRACT

The invention relates to sewing machines, wherein the needle is mounted on the needle bar with both a transverse offset and an angular offset with respect to the axis of the needle bar. It may be applied to sewing machines for both domestic and industrial use.

8 Claims, 2 Drawing Figures

SEWING MACHINES

The present invention relates to sewing machines for both domestic and industrial use, and more particularly to the assembly of the needle in the sewing machine.

In the manner known per se, this needle is fixed to a needle bar mounted for translation, the relative positions of the needle and of the needle bar not varying in use.

It is an object of the invention to provide a needle assembly means which facilitates the work of the user, by rendering the line of sewing perfectly visible.

To this end, according to the invention, the axis of the needle diverges downwardly from the axis of translation of the needle bar.

The needle is preferably mounted on the needle bar with both a transverse offset and an angular offset with respect to the axis of translation of the needle bar.

Figure 1:
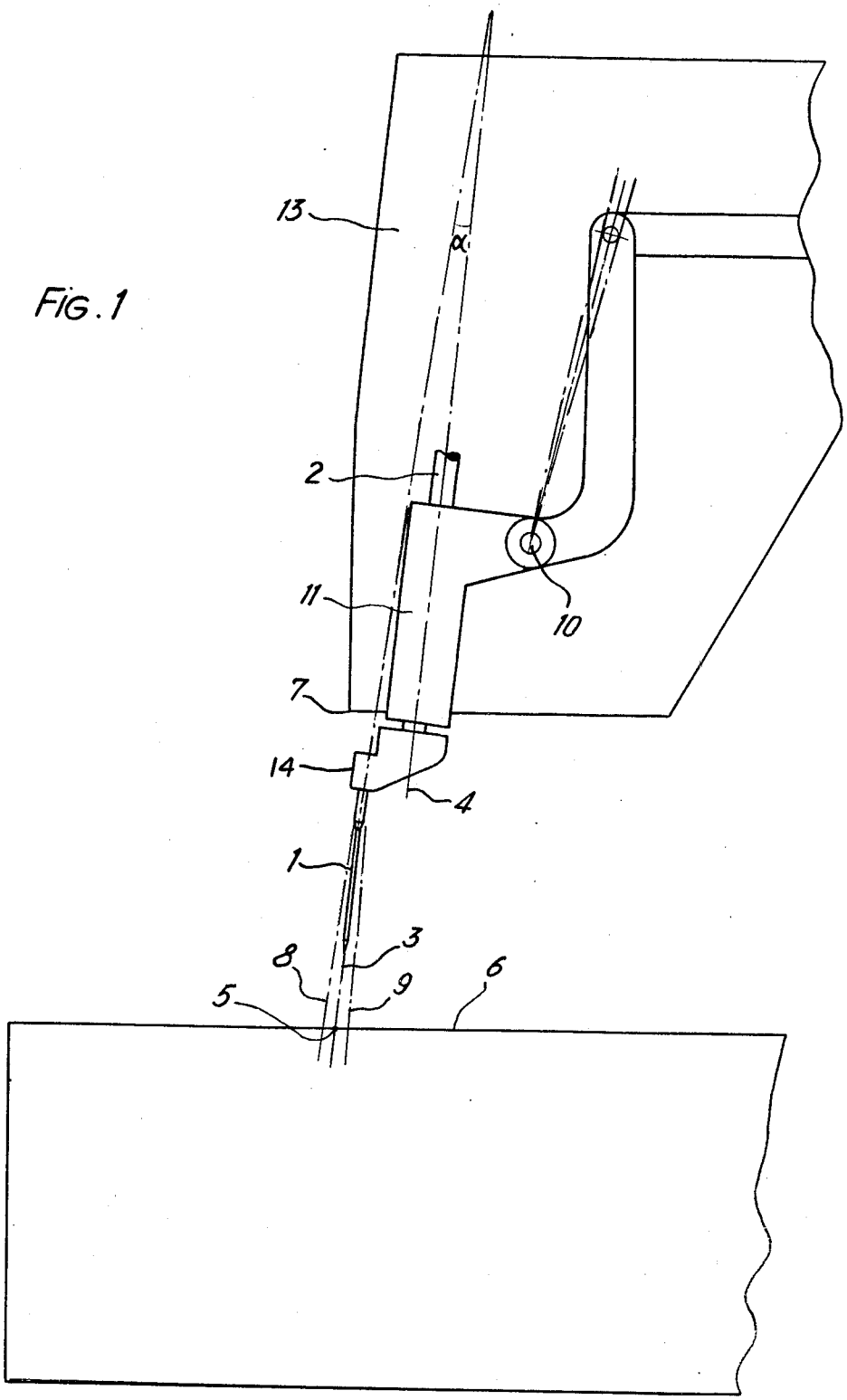
Figure 2:
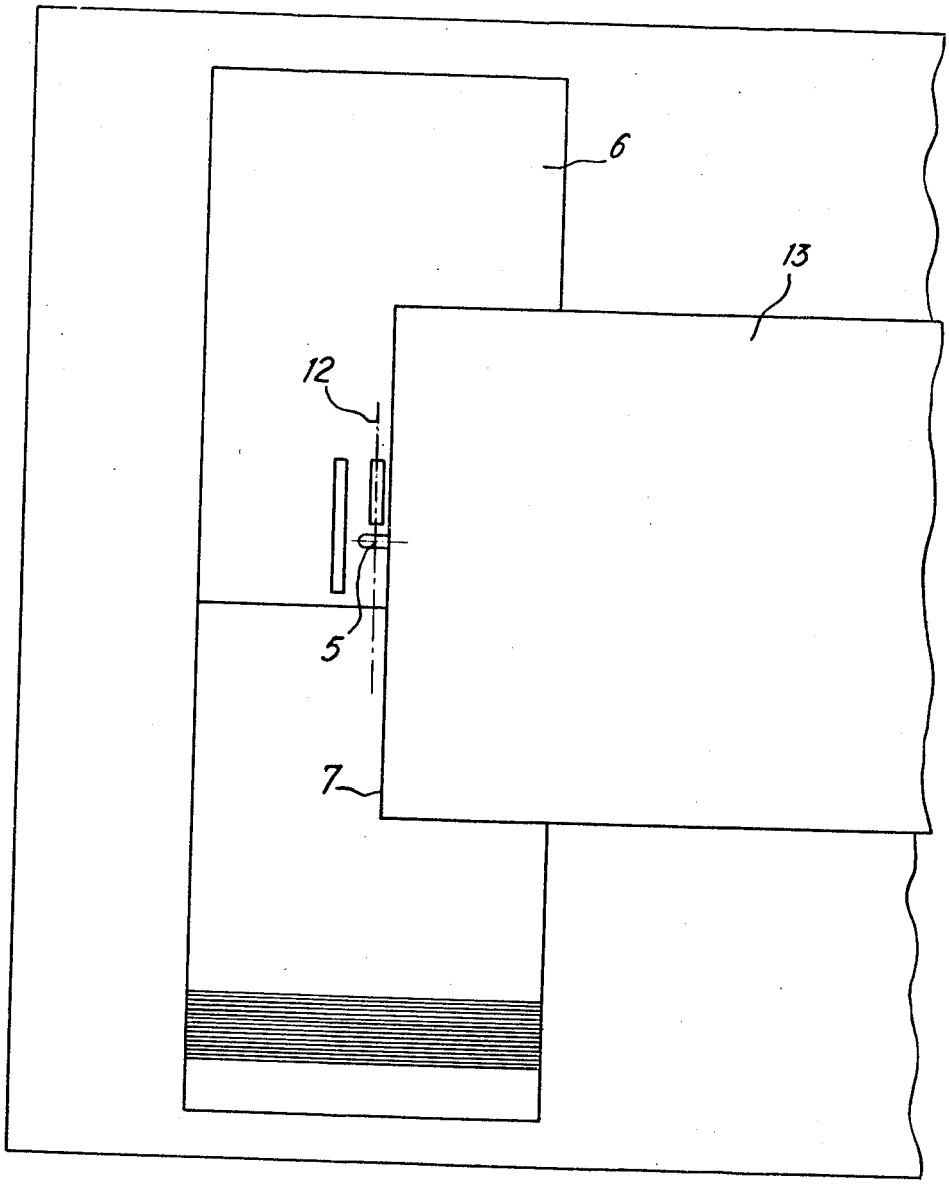

The invention will be more readily understood on reading the following description with reference to the accompanying drawings, in which:

FIG. 1 is a schematic, partial elevation of the assembly of the needle on the needle bar of a zig zag sewing machine according to the invention, and FIG. 2 is a plan view of the working surface of the machine.

Referring now to the drawings, FIG. 1 shows a needle 1 mounted for up-and-down reciprocating sliding movement on a needle bar 2, the latter being mounted in a shaft 11 and terminating at its lower end in an attachment 14 whereby the axis 3 of needle 1 is offset with respect to axis of translation 4 of needle bar 2, towards the left, as seen in FIG. 1 in a plane transverse to the general direction of sewing.

This offset is preferably less than about 15 mm at the point of attachment of the needle.

In addition, the axis 3 of the needle forms with the axis 4 of the needle bar an angle of from 4° to 10°, and preferably from 5° to 8°.

Due to this arrangement, the meeting point 5 of the axis of the needle and of the working surface 6 is either in the vertical plane passing through the edge 7 of the machine housing 13, or preferably outside said plane in the direction away from the housing.

Lines 8 and 9 of FIG. 1 represent the extreme positions of needle 1 during the pivoting of shaft 11 in which the needle bar slides. This pivoting occurs about an axis 10 in a manner known per se for a zig zag sewing machine.

FIG. 2 shows the line of sewing 12 which is clearly visible to the user to the left and below the edge 7 of the machine housing.

What is claimed is:

1. In a sewing machine having a housing, a working surface and a needle attached for reciprocating movement on a rigid needle bar mounted for translation movement, the relative positions of said needle and needle bar remaining unchanged during operation of the machine, the improvement comprising positioning of said needle such that its longitudinal axis diverges downwardly from the axis of translation of said needle bar, and such that said longitudinal axis of said needle crosses the working surface of said machine at a point located outside the area lying beneath said housing, whereby said point is clearly visible to the operator of said machine.

2. The sewing machine according to claim 1, wherein the angle of divergence of said axes is between 4 and 10 degrees.

3. The sewing machine according to claim 2, wherein the angle of divergence of said axes is between 5 and 8 degrees.

4. The sewing machine according to claim 1, wherein said axis of said needle is offset towards the line of sewing with respect to the axis of translation of the needle bar.

5. The sewing machine according to claim 4, wherein said offset is no greater than 15 mm at the point of attachment of said needle.

6. The sewing machine according to claim 1, wherein the crossing point of said axis of said needle and said working surface is in the vertical plane passing through the edge of said housing.

7. The sewing machine according to claim 1, comprising a zig zag sewing machine.

8. The sewing machine according to claim 1, wherein the crossing point of said axis of said needle and said working surface is outside the vertical plane passing through the edge of said housing.

* * * * *